US006691647B2

(12) United States Patent
Parker

(10) Patent No.: US 6,691,647 B2
(45) Date of Patent: Feb. 17, 2004

(54) ENGINE AND DRIVE SYSTEM

(76) Inventor: Brian Parker, 26 Cyril Street, Northampton (GB), NN1 5EL ( * ) Notice: Subject to any disclaimer, the term of this patent is extended or adjusted under 35 U.S.C. 154(b) by 78 days.

(21) Appl. No.: 09/890,534

(22) PCT Filed: Nov. 29, 2000

(86) PCT No.: PCT/GB00/04546

§ 371 (c)(1),
(2), (4) Date: Jan. 4, 2002

(87) PCT Pub. No.: WO01/40629

PCT Pub. Date: Jun. 7, 2001

(65) Prior Publication Data

US 2002/0134343 A1 Sep. 26, 2002

(30) Foreign Application Priority Data

Nov. 29, 1999 (GB) ..... 9928067

(51) Int. Cl.[7] ..... F02B 53/00
(52) U.S. Cl. ..... 123/18 A; 123/18 R; 123/245
(58) Field of Search ..... 123/248, 18 R, 123/18 A, 43 B, 245; 418/34, 36

(56) References Cited

U.S. PATENT DOCUMENTS

| | | | | | |
|---|---|---|---|---|---|
| 299,161 | A | * | 5/1884 | Peppard | 123/18 A |
| 1,352,127 | A | * | 9/1920 | Henderson | 123/18 A |
| 3,080,856 | A | * | 3/1963 | Berry | 123/18 A |
| 3,580,228 | A | | 5/1971 | Rocha | 123/18 A |
| 3,602,203 | A | | 8/1971 | Mowry | 123/18 A |
| 3,822,971 | A | | 7/1974 | Chahrouri | 418/36 |
| 3,938,480 | A | | 2/1976 | Yanda | 123/43 B |
| 4,899,957 | A | | 2/1990 | Eickmann | |
| 5,025,756 | A | * | 6/1991 | Nyc | 123/18 R |
| 6,305,345 | B1 | * | 10/2001 | Bakhtine | 123/245 |

FOREIGN PATENT DOCUMENTS

| | | | | |
|---|---|---|---|---|
| DE | 603172 | | 9/1934 | |
| DE | 2384102 | | 10/1978 | |
| DE | 3137979 | A1 * | 4/1983 | F01C/9/00 |
| DE | 3804411 | | 8/1989 | |
| DE | 3824539 | | 2/1990 | |
| DE | 4000384 | | 7/1991 | |
| DE | 4201127 | | 7/1993 | |
| EP | 40549 | A1 * | 11/1981 | F01C/9/00 |
| EP | 521540 | A1 * | 1/1993 | F02B/53/00 |
| GB | 2262965 | | 7/1993 | |

* cited by examiner

*Primary Examiner*—Thomas Denion
*Assistant Examiner*—Thai-Ba Trieu
(74) *Attorney, Agent, or Firm*—Knoble & Yoshida, LLC

(57) ABSTRACT

The engine comprises four open-ended curved cylinders (10) disposed in torroidal arrangement with respect to a central pivot point (11). Two piston arms (12) are pivoted about the point (11) and carry at their ends four pistons (13). Each piston (13) has two faces so mounted to the piston arm (12) as to face tangentially one away from the other for alt mate engagement with adjacent ends of two of the cylinders (10).

10 Claims, 5 Drawing Sheets

ENGINE AND DRIVE SYSTEM

The present invention relates to an engine and drive system, which may be used together or separately.

Internal combustion engines are well known and widely used. However, for several reasons, inherent in their basic design parameters, they are not as efficient as they could be.

One disadvantage of conventional internal combustion engines is that the moment of combustion is at top dead centre in the cycle, where the piston rod is at the most disadvantageous position, i.e. perpendicular to the piston face, and hence presenting a more rigid assembly. Thus the efficiency of the engine can never be perfect, and wear on the end bearings may be increased.

Another disadvantage is the high speed of rotation of the crankshaft. Usually, for most practical purposes, the speed must be reduced by gearing down, thus contributing further to toss of efficiency.

It is also the case that standard internal combustion engines are complicated with a large number of moving parts. The fewer parts there are, the fewer there are to go wrong. Hence, it is an object of the present invention to provide an engine which has fewer moving parts and offers a higher possibility of higher efficiency.

According to a first aspect of the present invention there is provided an engine comprising at least two open ended curved cylinders disposed in toroidal arrangement with respect to a central pivot point, at least two piston arms pivoted about said point, at least four pistons each one adapted to cooperate with one end of a respective cylinder and arranged in pairs so mounted to a piston arm as to face tangentially one away from the other for alternate engagement with adjacent ends of two of said at least two cylinders.

Preferably two piston arms are provided, each journalled for pivoting movement about said point and each having one said pair of pistons mounted at each end of the arm.

Advantageously, there are provided four cylinders and eight pistons.

Each piston arm may pivot through an angle of up to 33°, ideally 28°, 24°, or 21°.

The cylinders are arranged equiangularly about the periphery of a circle defined by said piston arms, and each may comprise a portion of either a circular or elliptical cross-section torus.

The two piston arms are disposed transversely and may be orthogonal at a median point in their respective reciprocating pivotal movements.

Each cylinder is provided with an inlet port adjacent one end and an exhaust port adjacent an opposite end, each closed by a respective piston during its inward travel and openable during the outward travel of said piston.

Movement of said pistons may be regulated by power take off/timing means which comprise a central axle and an arm rotatable thereabout, each diametrically opposed end of said arm being so connected by lever means to one of said two piston arms that the reciprocating pivotal movement of the piston arms is converted to continuous rotary movement of the central axle.

Optionally, said power take-off means may be provided with flywheel means to smooth out and maintain the rotary movement of the central axle.

According to another aspect of the present invention, there is provided a drive system comprising a first powered shaft, a second unpowered shaft spaced from and linked to said first shaft, at least one rotatable member freely journalled to said second shaft, at least one drive arm extending from said first shaft and at least one connection link means to connect a remote end of the or each said drive arm with a point on the or a respective one of said rotatable member spaced from said second shaft.

Embodiments of the present invention will now be more particularly described by way of example and with reference to the accompanying drawings, in which.

Figure 1:
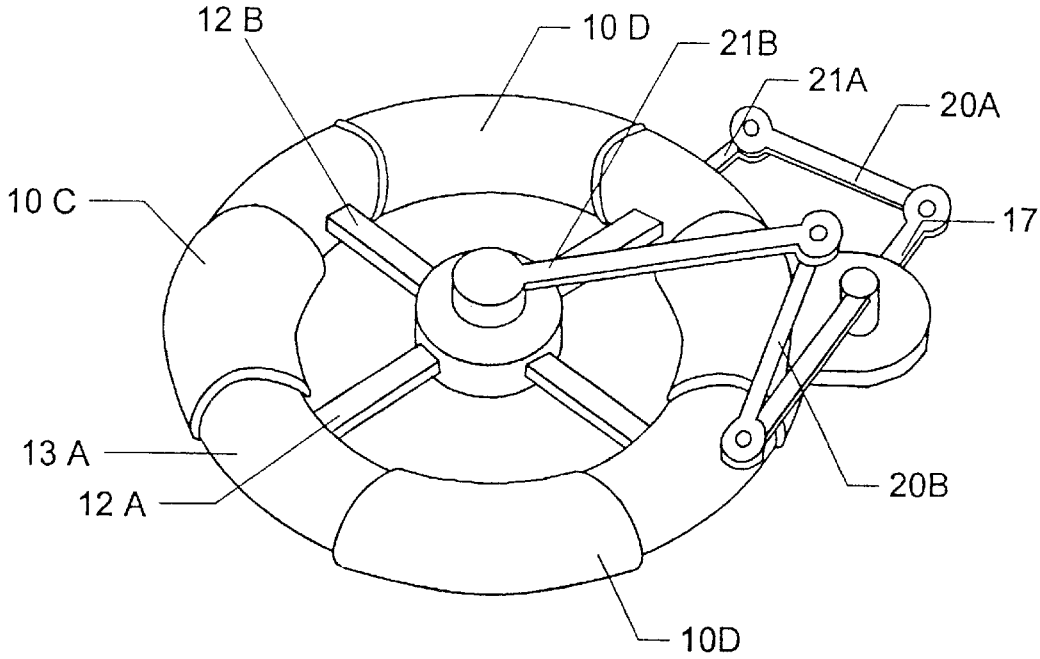
FIG. 1 shows a perspective view of one embodiment of the present invention in which the timing controls are connected to the central bearing.

Referring now to the drawings, there is shown an engine having four cylinders 10 arranged toroidally to encircle a central bearing 11, the cylinders being arranged as two opposite pairs.

Journalled around the central bearing 11 are two piston arms 12A and 12B. At the outermost ends of each piston arm 12A and 12B is a piston head 13A, 13B having two oppositely directed piston faces 14.

Each piston face 14 may be planar or may be so hollowed as to increase the size of the combustion chamber formed when the piston faces 14 of pistons 13A and 13B close together.

Figure 3:
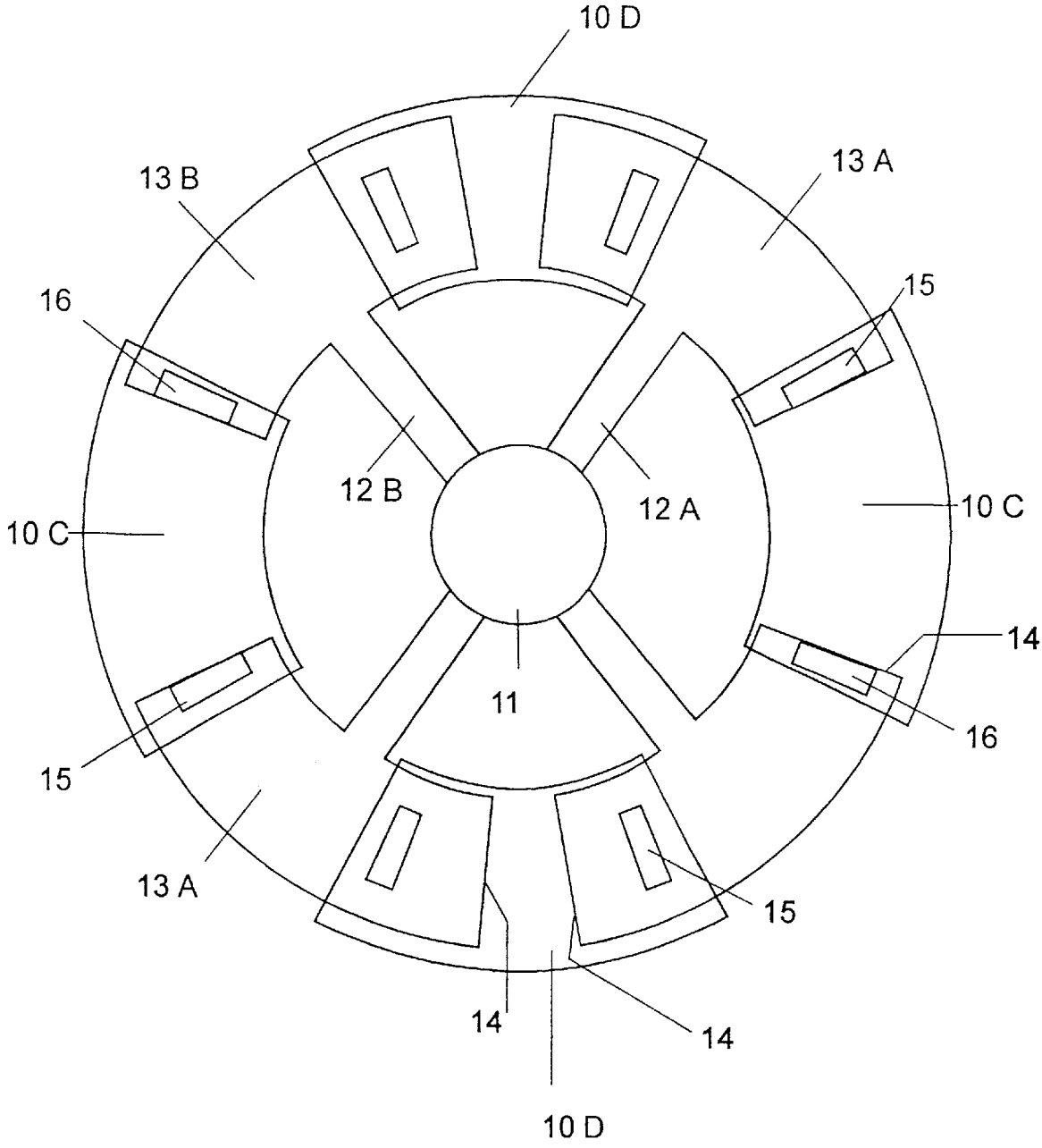
FIG. 3 shows in plan view an embodiment of the engine of the present invention.
Figure 4A:
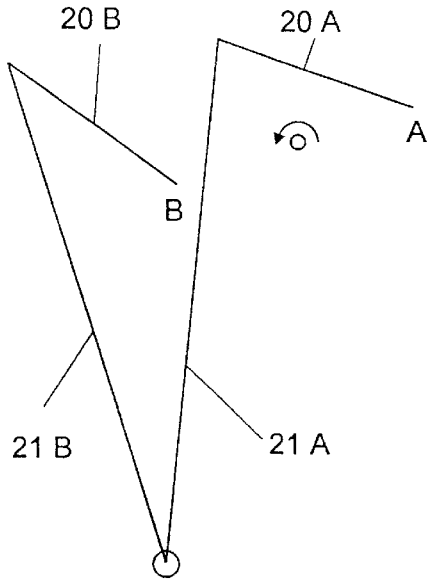
FIGS. 4A, 4B, 4C and 4D show schematically timing arrangements for one combustion cycle of the engine.
Figure 4B:
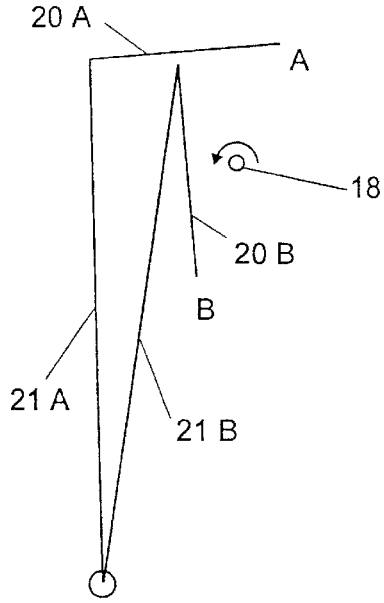
Figure 4C:
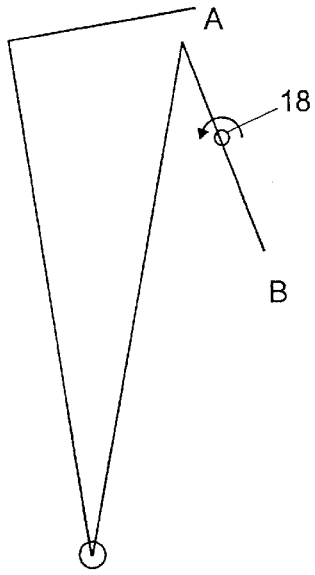
Figure 4D:
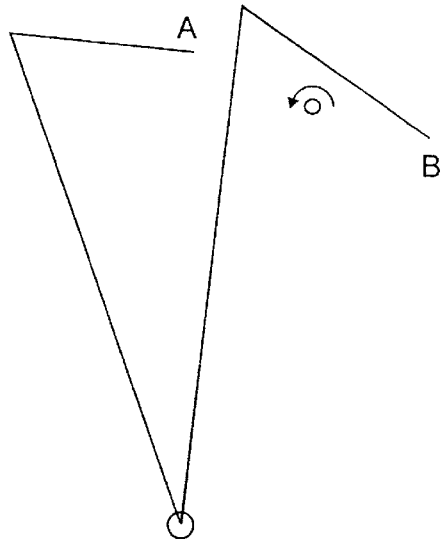

Referring now to FIG. 3 of the drawings, taking the pair of cylinders 10C at one moment in time, the piston arms 12A and 12B are moving together in a compression stroke. In such a stroke, initially, both inlet port 15 and exhaust port 16 are open. As the piston faces 14 advance into the pair of cylinders 10C, the pistons 13A and 13B move to close progressively first the exhaust port 16 and then the inlet port 15.

Once the inlet port 15 is closed, a charge of fuel is admitted to the pair of cylinders 10C, through suitable inlet means (not shown) and the piston faces 14 move further, one towards the other, to form a combustion chamber, and the fuel/air mixture is ignited.

During the same period of time, the opposite piston faces 14 of each of pistons 13A and 13B in cylinders 10D undergo a powerstroke and begin to move one away from the other. As the. exhaust 16 and inlet ports 15 are uncovered, the exhaust gases exit through the exhaust port 6 and the cylinder 10D is flushed by inlet air from port 15 until after the end of the power/expansion stroke and the beginning of the compression stroke.

Furthermore, the piston arms 12A and 12B move in a confined space into which air is inlet via a one way valve (not shown). During the engine compression strokes, the coming together one way or the other of piston arms 12A and 12B will compress this air in respective reservoir spaces between the arms, a cylinder 10 and the centre bearing 11. This compressed air may then be released into a cylinder at the appropriate point in the cycle thereof.

The power take-off is effected by means of arms 17 attached to a revolving take-off shaft 18.

Opposite ends of the arm 17 are journalled to a first end of respective connecting rods 20A and 20B. The second ends of the connecting rods 20A and 20B are journalled to move with either respective pistons 13A and 13B, or piston arms 12A and 12B.

In the embodiment shown in FIG. 1, the second ends of the connecting rods 20A and 20B are journalled to lever arms 21A and 21B which each oscillate with that part of the centre bearing 11 connected to a respective piston arm 12A or 12B.

Figure 2:
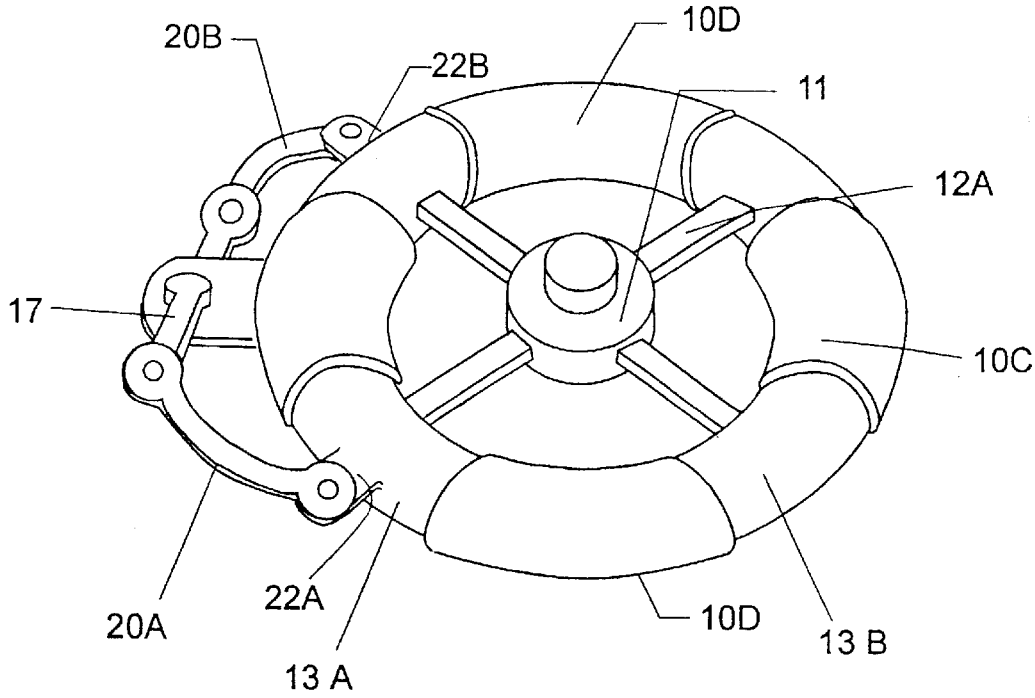
FIG. 2 shows a second embodiment of the present invention in which the timing controls are connected to two pistons of the engine.

In the embodiment shown in FIG. 2, the second ends of the connecting rods 20A and 20B are journalled to arms 22A and 22B which are themselves connected directly to an outward facing surface of one of each pair of pistons 13A and 13B to extend directly outwardly thereof, and to oscillate therewith.

In both embodiments, the take-off shaft 18 may be cranked (not shown) so as to allow free passage of the connection rods through the axis of the shaft.

Other methods of connection may be envisaged.

As can be seen from FIGS. 4A to 4D, where the takeoff shaft 18 is rotating in an anti-clockwise sense and is at a substantially constant speed, the relative angle between the lever arms 21A and 21B may change in an irregular manner. Hence, the events such as port opening and closing which are controlled by the piston arms via the lever arms, take place in a similarly controlled but irregular manner.

As can be seen, the exhaust ports 16 for each cylinder pair may be kept open for longer than the inlet ports 15 for the same cylinder pair despite there being a fairly constant speed of rotation of the take off shaft 18, by dint of suitable arrangement of the ports in the wall of the cylinder.

As may be seen, the engine of the present invention offers a number of advantages. For example, there need be no oil, water, associated pumps, filters, pressure or temperature sensors or gauges, belts or radiators.

Since there is no cylinder head, there are no gaskets and no leaks. The drive system is direct, therefore there need be no tappets, no timing chain, and used for no adjustments thereto. Overall, there is little or no need for servicing.

Optionally, either male or female piston rings may be used to effect a seal between pistons and cylinder bores. If used, they can be changed in a short time using basic tools. All bearings are mounted externally and are low speed sealed (TSL type) taper roller bearings with a long life expectancy (and which are in any case easy to change).

Depending on whether there are rings or no rings, either only the piston, only the cylinder or either needs to be ground smooth.

The engine and drive system are very simple and require very few parts, perhaps as few as fourteen. In any event, nearly all parts are in pairs or fours. Hence there are very low production costs and spare parts inventory. Construction is very simple with no expensive machining, and sizes can be moduled from very small to engines suitable for rail locomotives or even ships.

It may use any type of fuel, from natural gas to ships' bunker oil.

The engine or major components thereof may be made from such materials as cast metal, e.g. iron/aluminiumlbronze sheet mild steel; ceramic; plastic/ceramic armour material; and/or carbon fibre.

In use, the engine has very low internal friction, and is therefore very efficient.

Reliability should be improved since the pistons move more slowly and with a shorter stroke than for a conventional internal combustion engine, and so there will be less wear on all moving parts.

The only possible leaks are fuel, air, exhaust, and the only need for servicing involves the fuel and ignition systems.

There is no expense on oil, filters or anti-freeze as the engine may only require grease. There is no oil fouling of the vehicle, parking areas or race tracks (many accidents are caused by oil on a track).

The present internal combustion engine may be combined with an electric motor/generator for selective use to enable compliance with various "green" laws without being limited on range. For vehicle use, the power take-off/timing mechanism may include a simple differential gear. Several types could be used, adapted to allow electric only drive in town. The power take off may be apportioned between engine drive and generator, out of town, to regulate speed. Hence electric drive can be used in town, and internal combustion can be used outside town. Both together may be used for climbing hills or for maximum power, for example when overtaking.

Power output can be extracted from the present engine in various forms:

electrical—a.c., d.c., 50 Hz, 60 Hz;

hydraulic—oil, water, air pressure;

mechanical—rotary or reciprocal.

The compact size and flexible design of the engine and system allows many different types of installation, for example in drive shafts, to replace differentials, within wheels, under floors and the like.

Because of its very small size and compact shape, the engine arid drive could fit directly to an a axle in place of normal differential gear to release space used by conventional engine/gearbox systems. This would be useful, particularly in farm tractors within each rear wheel.

When the primary use of the engine is as a stationary engine, air cooling by fan is preferred, although water is possible. When the engine is employed in a moving vehicle, cooling may be afforded by unforced or fan-assisted airflow or by water.

If used as a stationary power source, the engine drive could be used as a generator of electric power.

Note that present engines run inefficiently at only half their optimum speed when used as an a.c. generator.

The designed engine speed is 1500–1800 rpm which is ideal and efficient for electrical generation. Furthermore, this approximately corresponds to the rotary speed of a wheel of a vehicle travelling at 100 mph, demonstrating the potential of the engine as a propulsion system employing direct drive.

If the intended primary use for the engine is hydraulic, as in hydraulic driven excavators or similar machinery, then the centre bearing interactive faces can be increased in size and no external power take off will be needed. This natural pumping action may be applicable for fluid pumps e.g. fire engine or other water pumps, or indeed in marine use for propulsion.

Two engines coupled in parallel to a common power take off would give very smooth output, particularly if they are adapted so as to run one half cycle out of phase.

For the purposes of simplicity in this description, only one power take-off/timing module is shown as being used but two or more would provide additional power take off points, e.g. useful for four wheel drive vehicles. In general, the power take-off/timing module or modules can be positioned at any distance from the centre bearing. It may be on any side or, where there are two, split symmetrically. Each module may be the same or of different scale sizes.

Optionally, a larger module may be employed as a power take-off point, while a smaller, gracile module is employed to regulate timing.

Alternatively, one large timing module can control and take power from two or more engine modules.

Other methods of operation of the engine allow the possibility of using water injection after ignition. This cools the engine, and the rapid expansion may give more power for external torsion. There is also the possibility of rich mixture chamber on cylinder.

The engine could accommodate variation in inlet and exhaust ports and air boost pressure so as to allow operation at altitude, e.g. by propeller aircraft at 2100 rpm, with no gear reduction. The engine is well adapted for use to propel helicopters, and variation in output differential type will allow helicopters to fly forwardly at substantially greater speeds than presently attainable.

The drive system of the invention may find use in direct drive of rotary take-offs such as helicopter blades, rotary lawn mowers and the like.

In the case of helicopters, the forward translational speed of the helicopter is limited by the rotary speed of the blades, since the helicopter is unstable when the blade speed on its rearward leg is less than the forward overall air speed.

Note that in present day helicopters the engine is at 90° to the drive to blades via a gearbox. The device of the present invention is direct without a gearbox.

In one embodiment of the invention, an additional shaft is provided, offset from the drive shaft. The blades are independently journalled at their roots for rotation about said additional shaft. Drive rods are provided, equal in number to the blades, fixed at one end to the drive shaft and bearing pivots at their outer ends. A linkage rod connects the outer end of each connection rod to a pivot situated partway along a blade. These linkage rods are journalled at each end for pivotal movement about the respective pivots on the drive rod and the blade. Hence. rotation of the drive shaft and the drive rods causes the blades to rotate, but as they rotate about the additional shaft, their angular speed varies, depending on their angular position. The highest angular speeds occur when the blade is positioned on the side of the additional shaft remote from the drive shaft. The drive is therefore arranged such that this is the side of the helicopter when the blade speed needs to outstrip the forward air speed.

Figure 5:
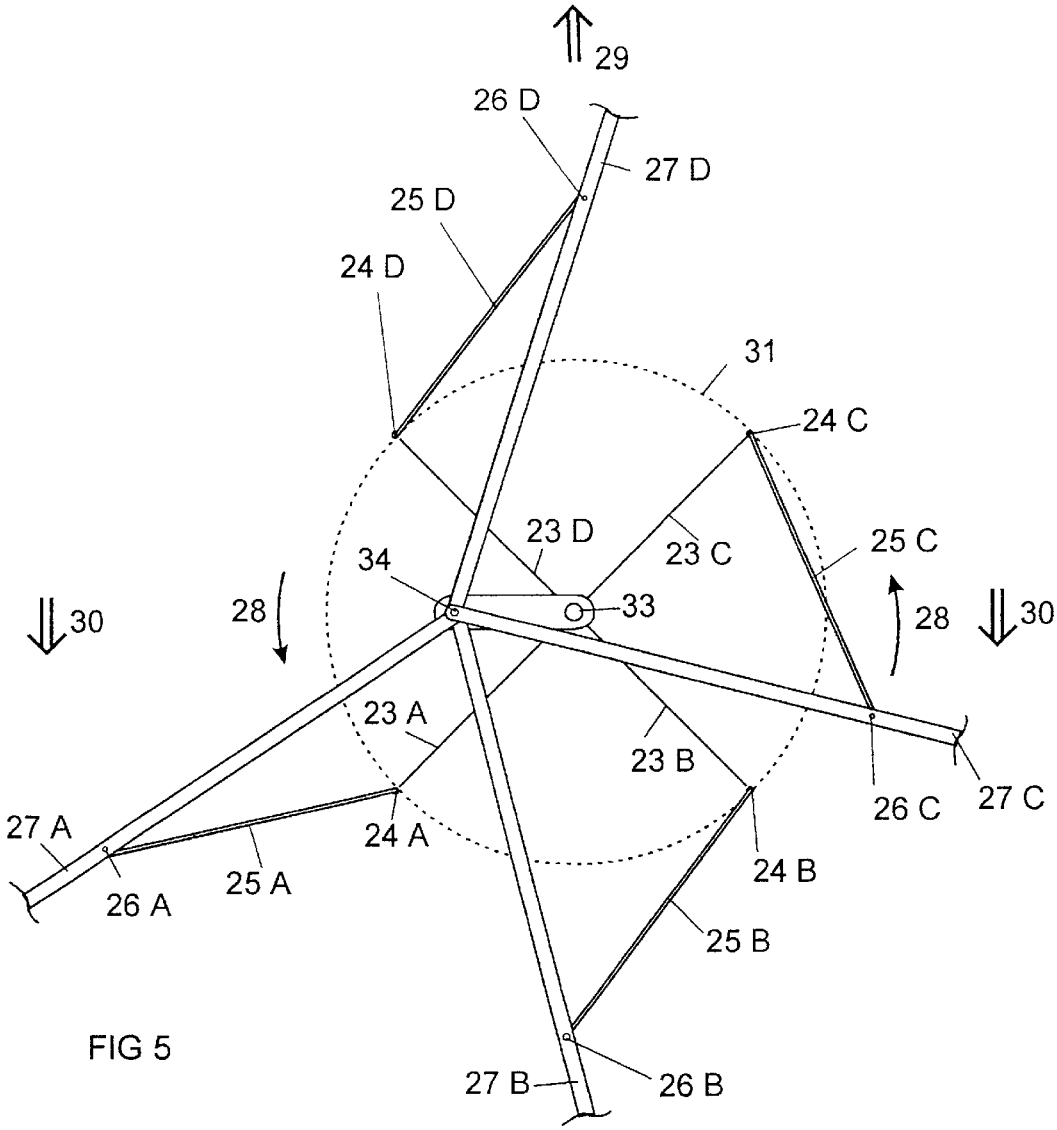
FIG. 5 shows a plan view of a drive system for a helicopter, driven by one embodiment of the present invention.

Referring now to FIG. 5 of the drawings, the additional shaft 34 is offset from the drive shaft 33, which may be directly driven from the power take-off 18 or otherwise. In this embodiment, there are four blades 27A, 27B, 27C, 27D, each journalled at the root to the shaft 34, such that it is capable of independent rotation about that shaft. (Alternatively, as an aid to comprehension, blades 27A, 27B, 27C, 27D may be considered as four successive positions of a single blade as it makes a revolution about the shaft 22). Drive rods 23A, 23B, 23C, 23D are fixed to drive shaft 21 at one end, such that they rotate with the shaft. Each drive rod bears a pivot 24A, 24B, 24C, 24D at the end remote from the drive shaft. Linkage rods 25A, 25B, 25C, 25D connect the pivots 24A. 24B, 24C, 24D respectively to further pivots 26A, 26B, 26C, 26D respectively, situated partway along blades 27A, 27B, 27C, 27D respectively. In operation, drive shaft 33 rotates in an anticlockwise sense 28, causing the pivots 24A, 24B, 24C, 24D to follow a circular path 31. As may be seen, the blades 27A, 27B, 27C, 27D are thereby caused to rotate about shaft 34, but their angular speed is constrained such that the blades travel faster on the left hand side (as seen) of the Figure than on the right hand side. The helicopter is travelling in direction 29, giving airflow 30 relative to the blades. The increased speed of the blade when passing from position 27D to 27A increases its speed relative to the airflow 30 and increases lift generation.

Alternatively, drive rods 23A, 23B, 23C, 23D may be replaced by a disc or wheel, centred on shaft 33. Line 31 then represents the circumference of said disc.

Figure 6:
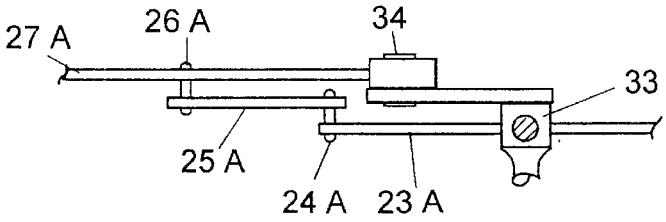
FIG. 6 shows a schematic side view of the system shown in FIG. 5.

FIG. 6 shows a schematic side view of the connections to one blade of FIG. 5, demonstrating how the various parts fit together.

Preferably, the shaft 34 is offset from the drive shaft 33 by a distance less than the length of the drive rods 23A, 23B, 23C, 23D. Should this offset distance be reduced to zero, then the motion of the blades becomes identical to the rotation of the drive shaft.

In the particular configuration shown in FIG. 5, the angular speed of the blades reaches a peak value almost three times that of the drive shaft, at a point between position 27D and position 27A. Over most of the path of the blades, their angular speed is reduced to between 60% and 80% of that of the drive shaft. Since they are then travelling head on into the airflow 30, their speed relative to the air and the lift generated are not significantly harmed.

Figure 7:
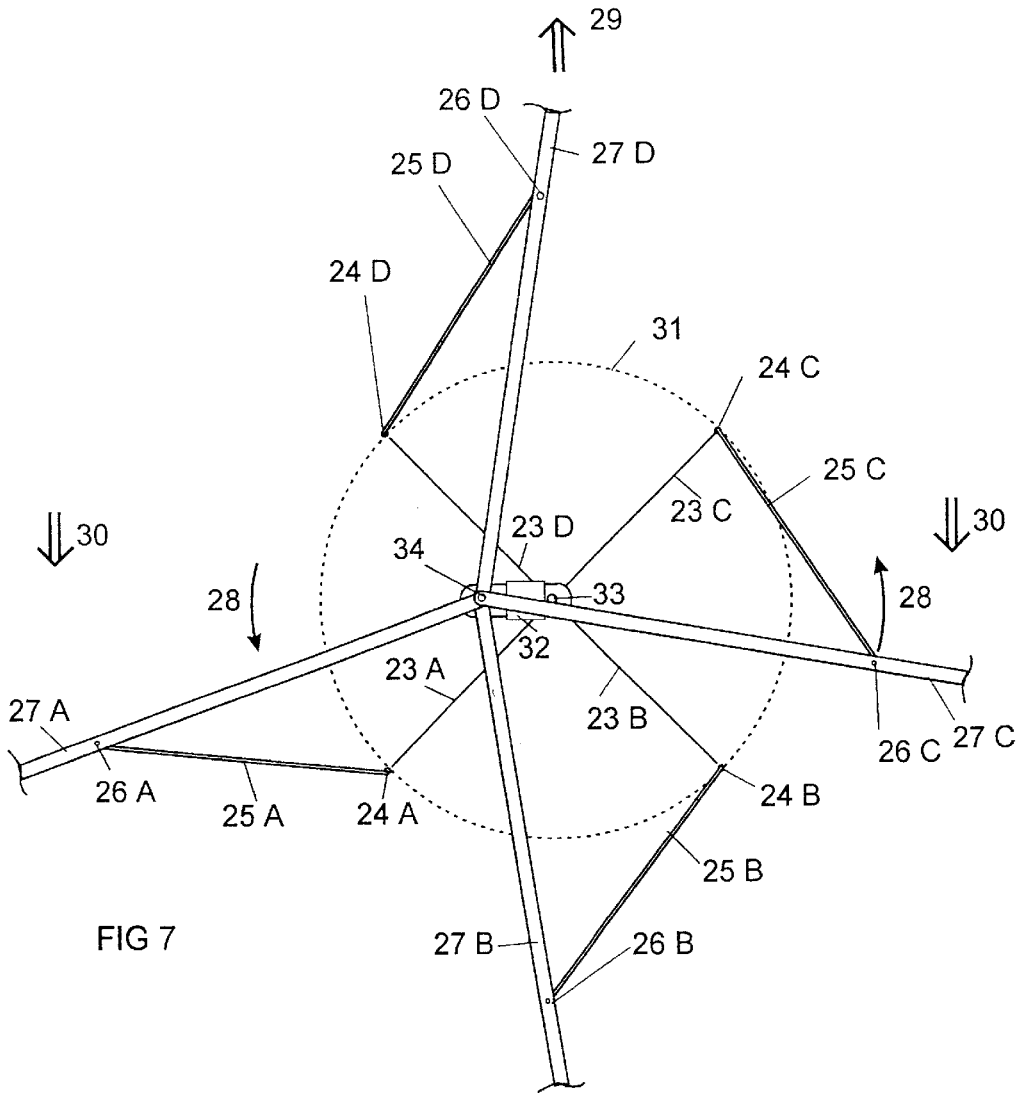
FIG. 7 shows a variable variant of the system shown in FIG. 5.
Figure 8:
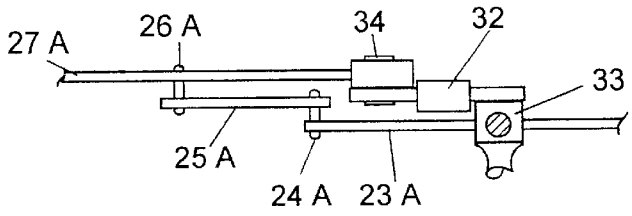
FIG. 8 is a schematic side view of the FIG. 7 system.

In a further variant, shown in FIG. 7, the offset distance between the shaft 34 and the drive shaft 33 is variable by means of a suitable mechanism 32. This mechanism may, for sake of example but not exclusively, comprise a sliding telescopic extensible arm (as shown) or a folding extensible arm, along with suitable control means. A side elevation is shown in FIG. 8. Adjustment of the offset distance alters the degree of variability in the angular speed of the blades, as shown from comparison of FIG. 5 with FIG. 7, where the offset distance is half of that in FIG. 5. The configuration of the system may thus be adjusted to suit the flight conditions. For example, the maximum offset might only be deployed when maximum forward speed is required.

Optionally, parallelogram linkages may be fitted in the blades, outboard of pivots 26A, 26B, 26C, 26D, in order to modify the angular disposition of the blades.

In some uses, it may be advantageous to couple more than one such drive system in series to amplify or exaggerate the variable speed outputs. Alternatively, such a drive system could be used in reverse to bring variable speed inputs back to a more constant output form.

A further advantage of the present invention when used to power helicopters is its convenient shape and drive arrangement. Most present day helicopters use a linear, horizontally-arranged engine, with the drive rotated by 90° to power the vertical drive shaft for the blades by means of a differential and a gearbox. The present invention produces an output to a vertical shaft, which may be connected directly to the drive shaft, giving a significant and very useful saving in weight and complexity.

What is claimed is:

1. An engine comprising at least two open ended curved cylinders disposed in toroidal arrangement with respect to a central pivot point, at least two piston arms pivoted about said point, at least four pistons , each one adapted to cooperate with one end of a respective cylinder and arranged in pairs so mounted to a piston arm as to face tangentially one away from the other for alternate engagement with adjacent ends of two of said at least two cylinders, wherein movement of said pistons is controlled by power take-off/timing means which comprise a central axle and an arm rotatable thereabout, lever means so connecting each diametrically opposed end of said rotatable arm to one of said at least two piston arms that the reciprocating pivotal movement of the piston aims is converted to continuous rotary movement of the take-off axle.

2. The engine as claimed in claim 1, wherein two piston arms are provided, each journalled for pivoting movement about said point and each having one said pair of pistons mounted at each end of the piston arm.

3. The engine as claimed in claim 2, wherein the two piston arms are disposed transversely and are orthogonal at a median point in their respective reciprocating pivotal movements.

4. The engine as claimed in claim 1, wherein four cylinders and eight pistons are provided.

5. The engine as claimed in claim 1, wherein each piston arm is pivotable through an angle of up to 33°.

6. The engine as claimed in claim 5, wherein the angle is no more than 28°, preferably no more than 21° to 24°.

7. The engine as claimed in claim 1, wherein the cylinders are arranged equiangularly about the periphery of a circle defined by said piston arms, and each comprises a portion of either a circular or elliptical cross-section torus.

8. The engine as claimed in claim 1, wherein each cylinder is provided with an inlet port adjacent one end and an exhaust port adjacent an opposite end, each closed by a respective piston during its inward travel and openable during the outward travel of said piston.

9. The engine as claimed in claim 1, further comprising a first powered shaft operatively connected to said take-off axle, a second unpowered shaft spaced from and linked to said first shaft, at least one rotatable member freely journalled to said second shaft, at least one drive arm extending from said first shaft and at least one connection link means to connect a remote end of the or each said drive arm with a point on the or a respective one of said rotatable member spaced from said second shaft.

10. The drive system as claimed in claim 9, wherein the distance between said first shaft and said second shaft is selectively variable.

* * * * *